United States Patent [19]

Mairs

[11] Patent Number: 4,698,862

[45] Date of Patent: Oct. 13, 1987

[54] COMBINATION BASSINET, BABY CARRIER AND DIAPER BAG

[76] Inventor: Candyce Mairs, 555 Centre Ct., Alameda, Calif. 94501

[21] Appl. No.: 10,602

[22] Filed: Feb. 4, 1987

[51] Int. Cl.[4] ..... A47C 29/00

[52] U.S. Cl. ..... 5/98 R; 5/99 A; 5/413

[58] Field of Search ..... 2/69.5; 5/89, 93 R, 5/94, 98 R, 99 A, 413; 224/158–160; 294/140, 150, 152

[56] References Cited

U.S. PATENT DOCUMENTS

| | | | |
|---|---|---|---|
| 2,197,333 | 4/1940 | Bianchi | 5/93 R |
| 2,227,251 | 1/1941 | Idelman | 2/69.5 |
| 2,502,486 | 4/1950 | Savrin | 224/6 |
| 2,551,509 | 5/1951 | Smith | 294/140 |
| 2,908,020 | 10/1959 | Barton | 5/99 |
| 3,096,917 | 7/1963 | Gudiksen | 5/98 R |
| 3,492,680 | 2/1970 | Coolidge | 5/99 |
| 4,068,786 | 1/1978 | Taniguchi | 224/6 |
| 4,254,900 | 3/1981 | Wheeler | 224/158 |
| 4,466,516 | 8/1984 | Sicoli et al. | 190/2 |
| 4,597,121 | 7/1986 | Bouma | 5/413 |

FOREIGN PATENT DOCUMENTS

| | | | |
|---|---|---|---|
| 71110 | 6/1950 | Denmark | 224/159 |

*Primary Examiner*—Gary L. Smith
*Assistant Examiner*—Michael F. Trettel
*Attorney, Agent, or Firm*—Townsend and Townsend

[57] ABSTRACT

A collapsible shell which can be folded over flat for storage, or partially closed for use as a tote bag, or expanded to a fully open position for use as a bassinet, is combined with a flexible sheet which doubles as both a liner for the bassinet and a body pack to strap a baby to the torso of an adult wearer. The parts are thus useable individually as a tote bag and body pack, or combinable as a padded bassinet.

13 Claims, 4 Drawing Figures

COMBINATION BASSINET, BABY CARRIER AND DIAPER BAG

BACKGROUND AND SUMMARY OF THE INVENTION

This invention relates to articles designed for the care. transport and comfort of babies.

The typical parent uses a large number and variety of products while caring for a baby and meeting its many needs. The need for so many products seriously cuts into the parent's mobility and time. Taking the baby along on even the shortest journey or errand frequently requires assembling a large number of objects and loading them individually into the family car.

The present invention provides an apparatus which is a combination of parts, readily foldable into a compact package for easy transport and storage. Individual parts of the combination may be used as, among other things, a front or back pack for carrying a baby by strapping to the adult's torso, and a tote bag for carrying diapers, clothing, feeding bottles, powder, and any number of other accessories. Alternatively, the parts may be combined to form a cushioned bassinet which is readily portable and transportable.

Included among the parts are a collapsible shell, preferably made of fabric partially reinforced, with straps allowing it to be carried by an adult preferably over the shoulder, and a removable liner of bunting material containing support straps for securing a baby to one side thereof. The liner doubles as both liner for the bassinet when placed inside the shell and blanket and body pack (front or back pack) when used alone. Fasteners along the side edges of the liner enable one to wrap and secure it around a baby's torso for use of the liner as a body pack. The fasteners serve a second function when it is desired to combine the liner with the shell for use as a bassinet. In the latter case, the fasteners are mated with fasteners along two side edges of the shell rather than with each other. To convert the shell from diaper bag to bassinet use, additional reinforcements are inserted in the shell to provide it with a rigid open structure to receive the baby once the liner is secured.

Further preferred embodiments of the structure include those in which the liner has a flap of material in each of its two ends, one foldable to form a foot sack for the baby and the other a hood, both for use when the liner is used as a body pack. In further preferred embodiments a resilient cushion such as an air mattress is also included to fit into the base of the shell when the latter is expanded, underneath the liner, providing further padding for the baby.

DETAILED DESCRIPTION OF THE INVENTION AND PREFERRED EMBODIMENTS

Figure 1:
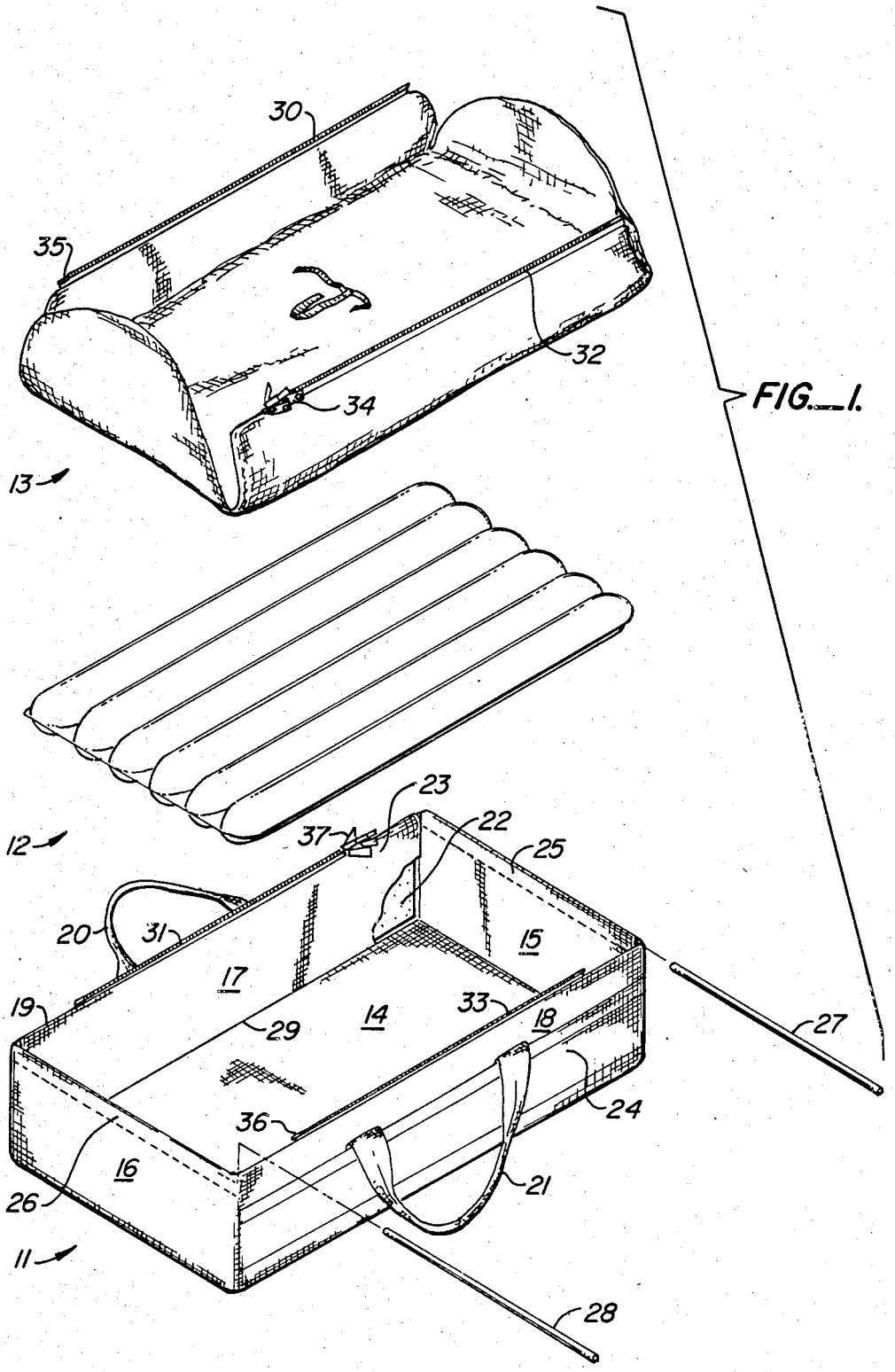
FIG. 1 is an exploded view in perspective of the various components of one illustrative embodiment of the combination of the present invention with the shell portion shown in cutaway.

The components in FIG. 1 include a shell 11, a resilient pad or mattress 12, and a liner 13, preferably padded.

Figure 4:
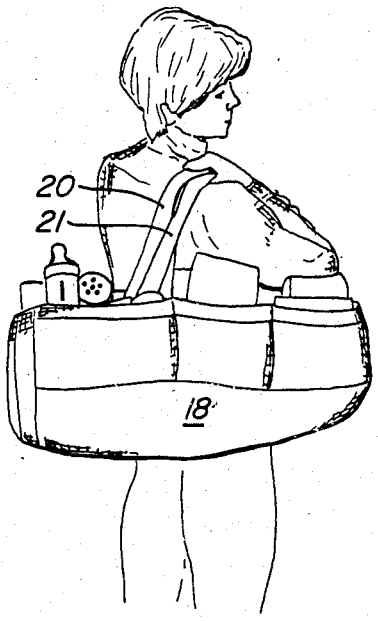
FIG. 4 is a sketch of the shell portion of the embodiment of FIG. 1 in use as a tote bag.

The shell 11 is in the form of a rectangular bag, formed by the base 14, a pair of opposing end walls 15, 16. and a pair of opposing side walls 17, 18. The shell is open at the top, forming a peripheral rim 19 formed by the upper edges of the end and side walls. The shell is made of flexible material rendering it collapsible either for storage or for use as a tote bag. For storage purposes, the shell may be collapsed horizontally by folding the side walls 17, 18 down toward each other, and the end walls 15, 16 creased inward and folded underneath the side walls, the base 14 remaining flat. For use as a tote bag, the side walls 17 and 18 may be drawn together, permitting the base 14 to curve downward and the end walls 15, 16 to fold either outward or inward. The carrying straps 20, 21 then conveniently pass over one shoulder of the adult or are simply gripped by hand. The sketch in FIG. 4 shows how the shell may be used in its tote bag configuration.

Collapsing of the shell in a manner convenient for storage and for use as a tote bag is achieved in the FIG. 1 embodiment by using rigid side walls 17, 18, leaving the end walls 15, 16 and base 14 flexible. This facilitates flat folding for storage and maintains a capacious yet easy-to-handle shape for the tote bag. Achievement of this rigidity in the side walls is readily obtained by inserting a rigid panel 22 in each side wall (shown in cutaway on the inside of the left side wall 17). These panels may for example be formed of such inexpensive readily available material as a sheet of corrugated cardboard. Such a sheet may be retained in the side wall by a sleeve 23 open at one end and extending substantially the full height and length of each side wall. This permits easy removal of the rigid panel 22 so that the shell may be cleaned.

A further feature of the shell in the embodiment shown in FIG. 1 are side pockets 24 opened at and accessible from the top for further storage.

To use the combination as a bassinet, one opens the shell to the configuration shown in FIG. 1, separating the side walls 17, 18 as far as possible and forming an open space into which the baby may be placed, over the resilient pad 12 and liner 13. The side walls 17, 18 may be held apart by any conventional reinforcing structure capable of being inserted and removed readily such as frames, panels, stretchers and the like. FIG. 1 shows a preferred arrangement, involving a pair of sleeves 25, 26 adjacent to the upper edges of the two end walls 15, 16, respectively, and extending the full width thereof. A pair of rods 27, 28 of rigid material such as metal or plastic are insertable into the sleeves 25, 26, respectively to hold the upper edges of the end walls substantially taught, thereby holding the side walls 17, 18 apart.

The resilient pad 12, preferably an inflatable air mattress, also serves to hold the shell 11 open by holding the inner seam 29 around the periphery of the base 14 in an opened or extended position as shown.

The liner 13, once inserted into the open shell 11 is securable thereto by fasteners 30, 31, 32, 33 along the side edges. These fasteners are designed such that they can be joined in either of two combinations—either one liner side border to the top edge of one shell side wall (30 with 31 and 32 with 33), or the two liner side borders to each other (30 with 32). Examples of such fasteners are common fabric or clothing accessories such as zippers, buttons, snaps, clasps and buckles. Preferred fasteners are zippers as depicted in the drawing. The tab 34 on one liner edge zipper track 32 can receive either the end 35 of the opposing zipper track 30 on the opposite side of the liner or the end 36 of the zipper track 33 on the same side of the shell 11. The tab 37 on the opposing zipper track 31 receives the end 35 of the liner zipper track 30 on the same side.

Figure 2A:
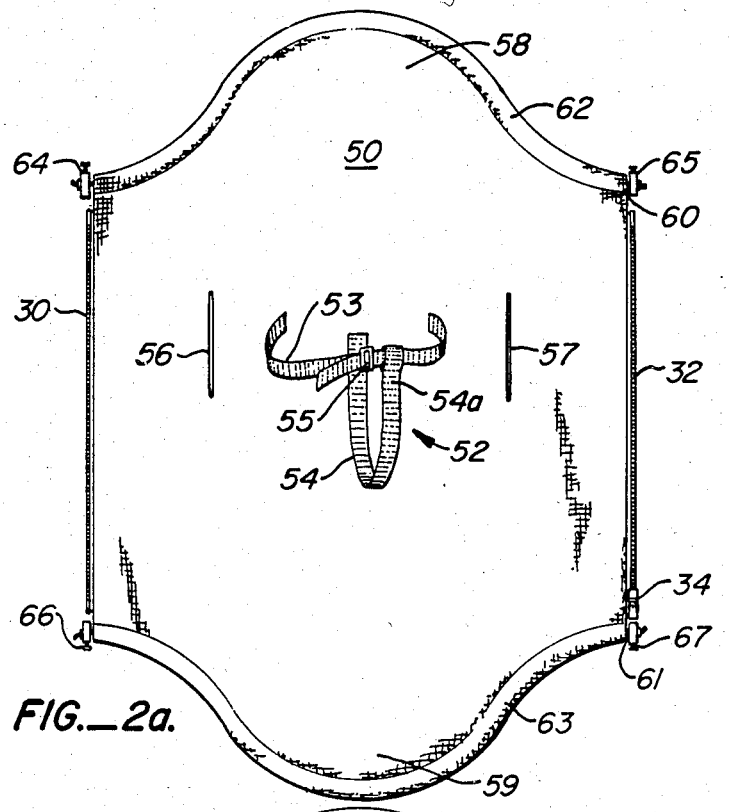
FIGS. 2*a* and 2*b* are plan views of the front and back sides, respectively, of the liner portion of the embodiment shown in FIG. 1.
Figure 2B:
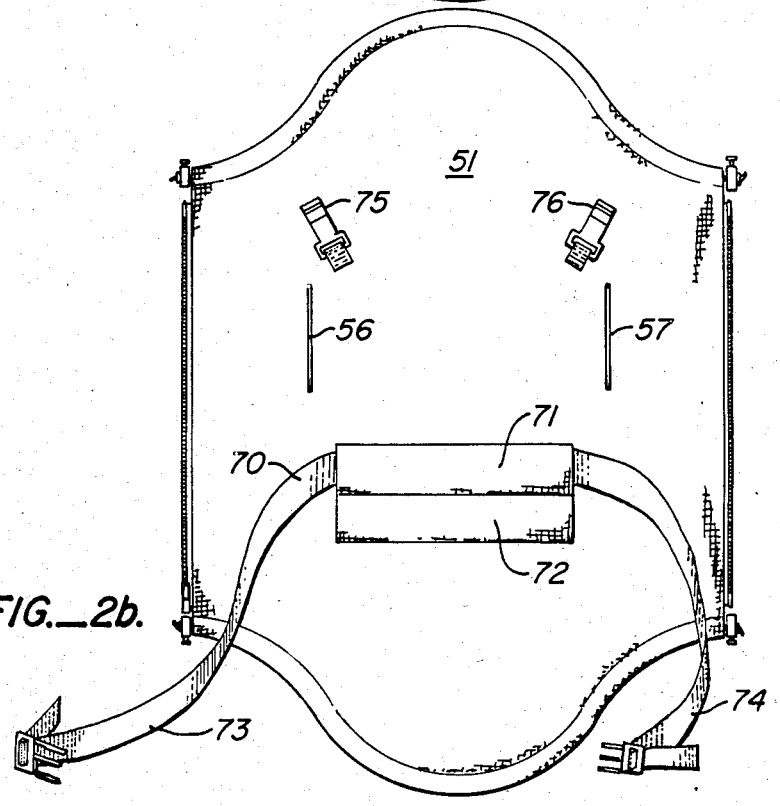

The liner 13 is shown spread out flat in FIGS. 2*a* and 2*b*. FIG. 2*a* shows the front side 50 of the liner, which is the side facing the baby, while FIG. 2*b* shows the back side 51. A support 52 capable of holding the baby in a vertical position is affixed to the center of the front side 50. By "vertical position" is meant the upright position that the baby will be in when the liner is held vertically when used as a front or back pack.

The support in the embodiment shown consists of a waist strap 53 for encircling the baby's waist, and a crotch strap 54 for passage between the baby's legs and joining the waist strap 53. A series of belt loops 54*a* permit the crotch strap to adjust to the height of the infant. A buckle 55 permits adjustment of the waist strap for a snug fit around the baby. A further feature of the embodiment shown is a pair of arm slots 56, 57 passing from the front side 50 through the liner to the back side 51. The baby's arms pass through these slots when the liner is folded around the baby.

The liner may also be used as a car seat cover, by passing the two halves of the car's seat belt through the two arm slots 56, 57, respectively and securing them tightly together either behind the baby or around its waist, or simply setting it into the car seat securing the belt over its shoulders depending on the car seat design.

Still further features of the liner shown in FIGS. 2*a* and 2*b* are a top flap 58 and a bottom flap 59 which may be folded forward to form a hood to protect the baby's head and a foot sack to encase the baby's legs, respectively. Alternatively, the flaps may be folded back out of the way, particularly the upper flap 58 thereby permitting free head movement of the baby. When it is desired to hold these flaps in a folded position, draw strings 60, 61 may be pulled through sleeves 62, 63, respectively, to constrict the edges of these flaps and draw them inward. The draw strings once pulled may be held in place by spring-mounted clamps 64, 65, 66, 67.

Figure 3:
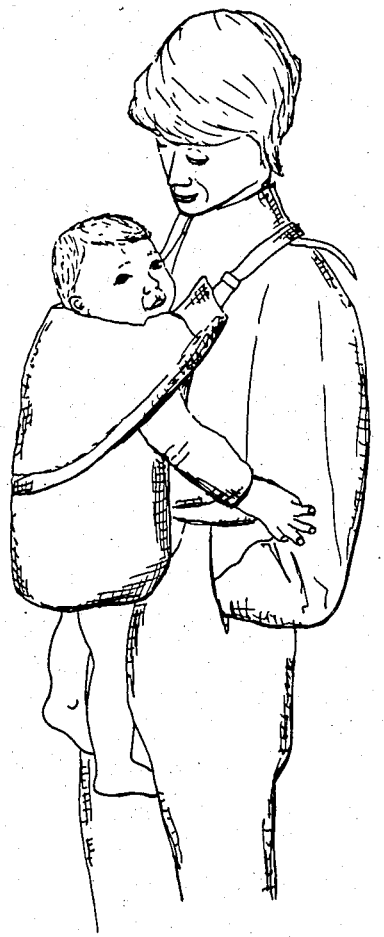
FIG. 3 is a sketch of the liner portion of the embodiment of FIG. 1 in use as a body pack.

On the back side 51 of the liner (FIG. 2*b*), a shoulder strap 70 is secured by passage through one of two sleeves 71, 72. In this embodiment, the two exposed halves 73, 74 of the strap function as two individual straps. Each half passes around the torso of the wearer and over the shoulder to join one of a pair of buckles 75, 76 situated on the upper half of the back side 51 of the liner. For attachment of these straps, the baby is first secured into the liner and the liner zipped together with the baby lying down. One strap is then joined to the buckle diagonally across from it, then placed over the shoulder of the wearer. The other strap is then brought across the back of the wearer and buckled. The result is depicted in FIG. 3.

The materials of construction are not critical, and will generally be selected for their flexibility, durability and washability. A heavy fabric such as canvas is preferred for the shell, exclusive of the reinforcing panels and rods. A quilted or cushioned fabric is preferred for the liner, and a waterproof material for the air mattress.

The foregoing is offered primarily for purposes of illustration. It will be readily apparent to those skilled in the art that numerous variations and modifications in the shapes and structures of the various components may be introduced without departing from the spirit and scope of the invention.

What is claimed is:

1. A combination bassinet, body pack and diaper bag, comprising:
   - a collapsible shell with a carrier strap affixed thereto and an open top;
   - removable means for holding said collapsible shell open;
   - a sheet of flexible material having affixed thereto:
   - means for vertically supporting a baby on one side thereof;
   - a shoulder strap sized to secure said sheet to the shoulder of an adult as a body pack; and
   - means for fastening each of two opposing edges of said sheet together around the torso of a baby retained in said vertical support means, and alternatively for fastening said two opposing edges to two opposing sides respectively of said collapsible shell to form a padded bassinet.

2. A combination in accordance with claim 1 in which said sheet contains slots positioned for passage of the arms of a baby retained in said vertical support means.

3. A combination in accordance with claim 1 in which said vertical support means is comprised of a waist encircling strap and a crotch support strap fastenable thereto.

4. A combination in accordance with claim 1 in which said fastening means comprised of a pair of zippers comprised of one row of teeth along each of said two opposing edges of said sheet and one row of teeth along each of two opposing sides of said open top of said collapsible shell.

5. A combination in accordance with claim 1 in which said collapsible shell is comprised of a base panel, first and second side panels, and first and second end panels, said base panel and end panels being of flexible fabric and said side panels being substantially rigid.

6. A combination in accordance with claim 5 in which said removable means is comprised of means for holding said end panels substantially taut.

7. A combination in accordance with claim 5 in which said removable means is comprised of first and second rigid supporting members securable to said first and second end panels respectively.

8. A combination in accordance with claim 5 in which said removable means is comprised of first and second rods and first and second sleeves in said end panels to receive said rods.

9. A combination in accordance with claim 8 in which said removable means is further comprised of a resilient pad shaped to fit inside said collapsible shell.

10. A combination in accordance with claim 9 in which said resilient pad is an inflatable air mattress.

11. A combination in accordance with claim 1 in which said shoulder strap is defined as a first shoulder strap and said sheet further has attached thereto a second shoulder strap, each of said first and second shoulder straps being secured at one end to a back side of said sheet defined as the side opposite that containing said vertical support means, said back side having further affixed thereto first and second buckles to receive the remaining ends of said first and second shoulder straps, respectively.

12. A combination in accordance with claim 1 in which said two opposing edges are defined as first and second opposing edges, and further comprising first and second flaps on said sheet along third and fourth opposing edges, respectively, joining said first and second opposing edges.

13. A combination bassinet, body pack and diaper bag, comprising:

a collapsible shell comprising first and second end panels, first and second side panels, a base panel, a carrier strap on each said side panel, and first and second rows of zipper teeth along substantially the full length of said first and side panels, respectively, said side panels being substantially rigid and said end panels and said base panel being of flexible material;

a sleeve in each said end panel and a rod insertable into each said sleeve to hold said side panels apart;

an air mattress sized to fit inside said collapsible shell; and a padded sheet of flexible material having front and back sides, with a crotch support strap affixed to said front side, slots extending therethrough positioned for passage of the arms of a baby retained in said crotch-support strap, first and second shoulder straps affixed to said back side, first and second buckles affixed to said back side to receive said first and second straps, and third and fourth rows of zipper teeth matable with each other and with said first and second rows of zipper teeth.

* * * * *